US009976455B2

(12) United States Patent
Kazaoka et al.

(10) Patent No.: US 9,976,455 B2
(45) Date of Patent: May 22, 2018

(54) INTERNAL COMBUSTION ENGINE AND HYDRAULIC CONTROLLER FOR INTERNAL COMBUSTION ENGINE

(71) Applicant: AISIN SEIKI KABUSHIKI KAISHA, Kariya-shi, Aichi-ken (JP)

(72) Inventors: Shinji Kazaoka, Kariya (JP); Kazunari Adachi, Chiryu (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 91 days.

(21) Appl. No.: 15/123,860

(22) PCT Filed: Oct. 1, 2014

(86) PCT No.: PCT/JP2014/076279
§ 371 (c)(1),
(2) Date: Sep. 6, 2016

(87) PCT Pub. No.: WO2015/132995
PCT Pub. Date: Sep. 11, 2015

(65) Prior Publication Data

US 2017/0016364 A1 Jan. 19, 2017

(30) Foreign Application Priority Data

Mar. 6, 2014 (JP) ..... 2014-043888

(51) Int. Cl.
*F01M 1/08* (2006.01)
*F01M 1/16* (2006.01)
*F02F 3/18* (2006.01)

(52) U.S. Cl.
CPC ..... *F01M 1/08* (2013.01); *F01M 1/16* (2013.01); *F02F 3/18* (2013.01)

(58) Field of Classification Search
CPC ..... F01M 1/08; F01M 2001/083; F01M 2001/086; F01M 1/16; F02F 3/18
See application file for complete search history.

(56) References Cited

U.S. PATENT DOCUMENTS

2013/0233271 A1* 9/2013 Zheng ..... F01M 3/04 123/196 CP

FOREIGN PATENT DOCUMENTS

| | | |
|---|---|---|
| EP | 2 405 165 A | 1/2012 |
| JP | 4599785 B2 | 12/2010 |
| JP | 2012-17796 A | 1/2012 |

OTHER PUBLICATIONS

International Search Report (PCT/ISA/210) dated Nov. 25, 2014, by the Japanese Patent Office as the International Searching Authority for International Application No. PCT/JP2014/076279.

(Continued)

*Primary Examiner* — Jacob Amick
(74) *Attorney, Agent, or Firm* — Buchanan Ingersoll & Rooney PC

(57) ABSTRACT

This internal combustion engine includes a piston, an oil jet that operates at a predetermined operating pressure to supply oil to the piston, and a hydraulic controller provided upstream of an oil passage including the oil jet. The hydraulic controller includes a constantly opened first passage through which the oil having a pressure lower than the predetermined operating pressure is supplied to the oil jet, a second passage provided alongside of the first passage and being openable and closable, through which the oil having a pressure higher than the predetermined operating pressure is supplied to the oil jet in combination with the first passage in a state where the same is opened, and an opening-closing control portion that controls the second passage to be in an open state when actuating the oil jet, and controls the second (Continued)

passage to be in a closed state when stopping actuating the oil jet.

15 Claims, 6 Drawing Sheets

(56) References Cited

OTHER PUBLICATIONS

Written Opinion (PCT/ISA/237) dated Nov. 25, 2014, by the Japanese Patent Office as the International Searching Authority for International Application No. PCT/JP2014/076279.

* cited by examiner

INTERNAL COMBUSTION ENGINE AND HYDRAULIC CONTROLLER FOR INTERNAL COMBUSTION ENGINE

TECHNICAL FIELD

The present invention relates to an internal combustion engine and a hydraulic controller for the internal combustion engine, and more particularly, it relates to an internal combustion engine including oil jets that supply oil (lubricating oil) to pistons and a hydraulic controller for the internal combustion engine.

BACKGROUND ART

In general, an internal combustion engine including oil jets that supply oil to pistons is known. Such an internal combustion engine is disclosed in Japanese Patent No. 4599785, for example.

In Japanese Patent No. 4599785, there is disclosed an internal combustion engine in which a main oil gallery and a sub oil gallery through which oil (lubricating oil) circulates are formed in a cylinder block. In this internal combustion engine described in Japanese Patent No. 4599785, a solenoid valve is provided between the main oil gallery and the sub oil gallery, and the sub oil gallery is connected with oil jets. The oil jets have a function of squirting oil (lubricating oil) for cooling to the back sides of pistons connected with con rods. Opening and closing of the solenoid valve are controlled on the basis of a command from an ECU (electronic control unit) during operation of the internal combustion engine so that in the open state of the solenoid valve, the oil of the main oil gallery is drawn into the sub oil gallery and is squirted from the oil jets. Thus, the temperature of the pistons reciprocating in a cylinder is controlled.

PRIOR ART

Patent Document

Patent Document 1: Japanese Patent No. 4599785

SUMMARY OF THE INVENTION

Problem to be Solved by the Invention

In the internal combustion engine described in Japanese Patent No. 4599785, the main oil gallery (main oil passage), which serves as an oil passage for constantly supplying oil to valve system timing members, such as camshafts and valve mechanism portions, and a crankshaft, is provided in the cylinder block, and the sub oil gallery (sub oil passage) branched off from the main oil gallery through the solenoid valve is separately provided. Furthermore, the solenoid valve is opened and closed, and the oil for cooling the pistons is squirted from the oil jets through the sub oil gallery, and hence there is such a problem that oil passages in the cylinder block are complicated due to the dedicated sub oil gallery (sub oil passage).

The present invention has been proposed in order to solve the aforementioned problem, and an object of the present invention is to provide an internal combustion engine capable of properly cooling the back sides of pistons by oil (lubricating oil) with a simple oil passage structure and a hydraulic controller for the internal combustion engine.

Means for Solving the Problem

In order to attain the aforementioned object, an internal combustion engine according to a first aspect of the present invention includes a piston, an oil jet that operates at a predetermined operating pressure to supply oil to the piston, and a hydraulic controller provided upstream of an oil passage including the oil jet, and the hydraulic controller includes a first passage in a constantly open state, through which the oil having a pressure lower than the predetermined operating pressure is supplied to the oil jet, a second passage provided alongside of the first passage and being openable and closable, through which the oil having a pressure higher than the predetermined operating pressure is supplied to the oil jet in combination with the first passage in a state where the second passage is opened, and an opening-closing control portion that controls the second passage to be in an open state when actuating the oil jet, and controls the second passage to be in a closed state when stopping actuating the oil jet.

In the internal combustion engine according to the first aspect of the present invention, as hereinabove described, the hydraulic controller including the first passage in a constantly open state, through which the oil having the pressure lower than the predetermined operating pressure is supplied to the oil jet, the second passage provided alongside of the first passage and being openable and closable, through which the oil having the pressure higher than the predetermined operating pressure is supplied to the oil jet in combination with the first passage in a state where the second passage is opened, and the opening-closing control portion that controls the second passage to be in the open state when actuating the oil jet, and controls the second passage to be in the closed state when stopping actuating the oil jet is provided upstream of the oil passage including the oil jet. Thus, during a period in which the second passage is closed, the oil (lubricating oil), of which the oil pressure has been reduced to less than the predetermined operating pressure, can be continuously supplied to the downstream side of the oil passage including the oil jet only through the first passage in a constantly open state. Only when the second passage is opened, the oil can be reliably supplied to the oil jet through the first passage and the second passage. More specifically, a function of supplying the oil to a portion (crankshaft or the like) constantly requiring the oil during the operation of the internal combustion engine and a function of supplying the oil to the back side of the piston by opening the second passage when the internal combustion engine shifts to a high load (high rotational speed range) so that the oil pressure is increased can be properly used as the situation demands with the hydraulic controller including a single (common) oil passage including the first passage and the second passage and the opening-closing control portion. Therefore, according to the present invention, simply by adding the hydraulic controller according to the present invention to the existing oil passage through which the oil is supplied to the crankshaft and the piston, for example, the oil jet can be actuated as needed while the oil is constantly supplied to the crankshaft or the like. Thus, it is not necessary to separately provide a dedicated sub oil passage for supplying the oil from a main oil passage in a cylinder block to the oil jet, provide an opening-closing control valve or the like in the sub oil passage, and switch a supply destination of the oil according to the state of the internal combustion engine. Consequently, it is not necessary to provide the dedicated sub oil passage, and hence the back side of the piston can be properly cooled by the oil (lubricating oil) with a simple oil passage structure.

Preferably in the aforementioned internal combustion engine according to the first aspect, the first passage includes a fixed restrictor in a constantly open state, having a first oil passage diameter, and the second passage includes an openable and closable bypass passage having a second oil passage diameter larger than the first oil passage diameter. According to this structure, the oil (lubricating oil), of which the oil pressure has been reduced to less than the predetermined operating pressure, can be continuously supplied to the downstream side of the oil passage including the oil jet through the first passage, to which a predetermined resistance (flow passage resistance) is applied, by the fixed restrictor having the first oil passage diameter in the single (common) oil passage including the first passage and the second passage. Furthermore, the bypass passage having the second oil passage diameter larger than the first oil passage diameter of the second passage is opened, whereby the oil can be easily supplied also to the oil jet connected to the downstream side of the oil passage in a state where the entire oil passage is switched to a resistance (flow passage resistance) smaller than that of the fixed restrictor of the first passage.

Preferably in the aforementioned internal combustion engine according to the first aspect, the opening-closing control portion includes a first solenoid valve that is connected to the second passage and controls opening and closing of the second passage. According to this structure, the opening and closing operation of the second passage to be controlled (driven) by the first solenoid valve can be easily performed by effectively utilizing the opening and closing operation of a drive valve, of which the response speed is fast, using the electromagnetic force of an electromagnet (solenoid portion). Furthermore, the first solenoid valve capable of retaining only one of a fully open state and a fully closed state is used as the opening-closing control portion, whereby the opening and closing operation (control of switching between start and stop of the oil jet) of the second passage in the hydraulic controller can be reliably performed.

Preferably in the aforementioned internal combustion engine according to the first aspect, the opening-closing control portion includes the first solenoid valve that is connected to the second passage and controls opening and closing of the second passage, and the second passage is controlled to be in the open state when the first solenoid valve is non-energized. According to this structure, when the first solenoid valve is broken down and is constantly in a non-energized state, in the hydraulic controller, the second passage is opened, and hence the oil can be reliably supplied to the back side of the piston through the second passage even when the internal combustion engine shifts to the high load (high rotational speed range) so that the oil pressure is increased. Furthermore, during the period in which the internal combustion engine operates for a long time and it is necessary to cool the piston, electric power supply to the first solenoid valve can be stopped, and hence power consumption used to control the hydraulic controller (first solenoid valve) can be reduced.

Preferably, the internal combustion engine according to the first aspect further includes an internal combustion engine body provided with an upstream oil passage located upstream of the hydraulic controller and a downstream oil passage located downstream of the hydraulic controller and including a side surface portion on which an end of each of the upstream oil passage and the downstream oil passage closer to the hydraulic controller is opened to an outside, and the upstream oil passage and the downstream oil passage are communicated with each other through the hydraulic controller by mounting the hydraulic controller on the side surface portion of the internal combustion engine body. According to this structure, simply by mounting the hydraulic controller on the side surface portion of the internal combustion engine body from the outside, the internal combustion engine having a simple oil passage structure (the structure of the oil passage for actuating the oil jet as needed while the oil is constantly supplied to the crankshaft or the like) can be easily obtained.

Preferably in this case, the first passage that has a tube shape and connects the upstream oil passage and the downstream oil passage is formed in a region in which the hydraulic controller and the side surface portion of the internal combustion engine body face each other in a state where the hydraulic controller is mounted on the side surface portion of the internal combustion engine body. According to this structure, the first passage having a tube shape can be easily formed simply by mounting the hydraulic controller on the side surface portion of the internal combustion engine body from the outside. Furthermore, the groove-like (gutter-shaped) first passage can be exposed on the mounting surface of the hydraulic controller simply by detaching the hydraulic controller from the side surface portion of the internal combustion engine body when the hydraulic controller is disassembled and cleaned, for example. Therefore, the first passage can be easily cleaned.

Preferably, the aforementioned internal combustion engine according to the first aspect further includes an oil pump that supplies the oil to the oil jet, and the hydraulic controller is arranged between the oil pump and the oil jet. According to this structure, when the second passage is opened, the oil can be easily supplied to the oil jet through the first passage and the second passage while the oil is supplied to a downstream oil-requiring portion only through the first passage in a constantly open state along with application of an oil pressure generated by the oil pump to the hydraulic controller.

Preferably in the aforementioned structure further including the oil pump, the oil pump includes a variable displacement oil pump, and the discharge rate of the variable displacement oil pump is increased when the second passage is controlled to be in the open state by the opening-closing control portion. According to this structure, the discharge rate of the variable displacement oil pump is increased, whereby the oil can be supplied to the oil jet through the second passage in a state where the oil has a sufficient oil pressure. More specifically, the oil having the pressure higher than the predetermined operating pressure can be easily supplied to the oil jet, and hence the oil can be reliably squirted from the oil jet to cool the piston.

Preferably in this case, the internal combustion engine further includes a second solenoid valve that is connected to the variable displacement oil pump and controls the discharge rate of the variable displacement oil pump according to opening and closing control of the opening-closing control portion of the hydraulic controller. According to this structure, the discharge rate of the variable displacement oil pump to be controlled (driven) by the second solenoid valve (increase and decrease in the discharge rate) can be easily controlled by effectively utilizing the opening and closing operation of a drive valve, of which the response speed is fast, using the electromagnetic force of an electromagnet (solenoid portion).

Preferably in the aforementioned internal combustion engine according to the first aspect, the hydraulic controller further includes a valve body capable of switching the second passage to the open state or closed state, and the opening-closing control portion moves the valve body with an oil pressure supplied to the oil jet to switch the second passage to the open state or closed state. According to this structure, the opening-closing control portion properly controls a way of applying the oil pressure to the valve body, whereby the second passage can be easily switched to the open state or closed state. Therefore, the power consumption of the internal combustion engine can be reduced unlike the case where the valve body of the hydraulic controller is moved directly utilizing an electric drive force.

Preferably in the aforementioned internal combustion engine according to the first aspect, the oil passage includes a first circulation oil passage through which the oil is supplied to a valve system and a second circulation oil passage including the oil jet that supplies the oil to a crankshaft and the piston, and the second circulation oil passage includes the first passage and the second passage provided alongside of the first passage and being openable and closable. According to this structure, the hydraulic controller including the single (common) oil passage including the first passage and the second passage can be provided in the second circulation oil passage through which the oil is supplied to the crankshaft and the back side of the piston. Thus, control of switching between start and stop of the oil jet can be performed by the hydraulic controller regardless of an operation of oil supply to the valve system through the first circulation oil passage.

Preferably in this case, the internal combustion engine further includes an oil pump that supplies the oil to the oil jet, and the second circulation oil passage is branched off from the first circulation oil passage connected to the oil pump. According to this structure, the oil can be reliably supplied to the crankshaft through the first passage of the second circulation oil passage branched off from the first circulation oil passage through which the oil is constantly supplied to the valve system during the operation of the internal combustion engine. Furthermore, the second passage is opened as needed, whereby the oil can be reliably supplied also to the crankshaft and (the back side of) the piston.

Preferably in the aforementioned internal combustion engine according to the first aspect, the opening-closing control portion controls the second passage to be in the open state on the basis of at least one of that the temperature of the piston has reached more than a predetermined temperature and that the rotational speed of a crankshaft has reached at least a predetermined rotational speed. According to this structure, the second passage is closed when the temperature of the piston has not reached the predetermined temperature (in a state where the oil pressure is temporarily increased due to an oil viscosity at a low oil temperature such as immediately after the start of the internal combustion engine), and hence supply (squirt) of the oil to the back side of the piston at the low oil temperature can be easily prevented. On the other hand, when the low oil temperature state is released and the internal combustion engine shifts to the high load (high rotational speed range) so that the oil pressure is increased, in addition to constant oil supply to the crankshaft, the oil can be reliably supplied (squirted) also to the back side of the piston through the oil jet. Thus, seizure of the piston can be easily prevented.

Preferably in this case, the opening-closing control portion determines whether or not the temperature of the piston has reached more than the predetermined temperature when the rotational speed of the crankshaft has not reached at least the predetermined rotational speed, and controls the second passage to be in the open state when the rotational speed of the crankshaft has not reached at least the predetermined rotational speed and the opening-closing control portion determines that the temperature of the piston has reached more than the predetermined temperature. According to this structure, even when the rotational speed of the internal combustion engine is in a low rotational speed range, the temperature of the piston become higher in a circumstance where high load operation is performed (at the time of requiring a high torque such as when a vehicle ascends a hill at a low speed), and hence the oil can be reliably supplied (squirted) to the back side of the piston through the oil jet. Thus, the piston is properly cooled so that seizure of the piston can be easily prevented.

A hydraulic controller for an internal combustion engine according to a second aspect of the present invention includes a first passage in a constantly open state, provided upstream of an oil passage including an oil jet that supplies oil to a piston of the internal combustion engine by operating at a predetermined operating pressure, through which the oil having a pressure lower than the predetermined operating pressure is supplied to the oil jet, a second passage provided alongside of the first passage and being openable and closable, through which the oil having a pressure higher than the predetermined operating pressure is supplied to the oil jet in combination with the first passage in a state where the second passage is opened, and an opening-closing control portion that controls the second passage to be in an open state when actuating the oil jet, and controls the second passage to be in a closed state when stopping actuating the oil jet.

As hereinabove described, the hydraulic controller for an internal combustion engine according to the second aspect of the present invention includes the first passage in a constantly open state, through which the oil having a pressure lower than the predetermined operating pressure is supplied to the oil jet, the second passage provided alongside of the first passage and being openable and closable, through which the oil having a pressure higher than the predetermined operating pressure is supplied to the oil jet in combination with the first passage in a state where the second passage is opened, and the opening-closing control portion that controls the second passage to be in an open state when actuating the oil jet, and controls the second passage to be in a closed state when stopping actuating the oil jet. Thus, during a period in which the second passage is closed, the oil (lubricating oil), of which the oil pressure has been reduced to less than the predetermined operating pressure, can be continuously supplied to the downstream side of the oil passage including the oil jet only through the first passage in a constantly open state. Only when the second passage is opened, the oil can be reliably supplied to the oil jet through the first passage and the second passage. More specifically, a function of supplying the oil to a portion (crankshaft or the like) constantly requiring the oil during the operation of the internal combustion engine and a function of supplying the oil to the back side of the piston by opening the second passage when the internal combustion engine shifts to a high load (high rotational speed range) so that the oil pressure is increased can be properly used as the situation demands with the hydraulic controller including a single (common) oil passage including the first passage and the second passage and the opening-closing control portion. Therefore, according to the present invention, simply by adding the hydraulic controller according to the present invention to the existing oil passage through which the oil is supplied to the crankshaft and the piston, for example, the oil jet can be actuated as needed while the oil is constantly supplied to the crankshaft or the like. Thus, it is not necessary to separately provide a dedicated sub oil passage for supplying the oil from a main oil passage in a cylinder block to the oil jet, provide an opening-closing control valve or the like in the sub oil passage, and switch a supply destination of the oil according to the state of the internal combustion engine. Consequently, it is not necessary to provide the dedicated sub oil passage, and hence the back side of the piston can be properly cooled by the oil (lubricating oil) with a simple oil passage structure.

Effect of the Invention

According to the present invention, as hereinabove described, the internal combustion engine capable of properly cooling the back side of the piston by the oil (lubricating oil) with a simple oil passage structure and the hydraulic controller for the internal combustion engine can be provided.

MODES FOR CARRYING OUT THE INVENTION

Embodiments of the present invention are hereinafter described on the basis of the drawings.

First Embodiment

The structure of an engine 100 according to a first embodiment of the present invention is now described with reference to FIGS. 1 to 5.

Figure 1:
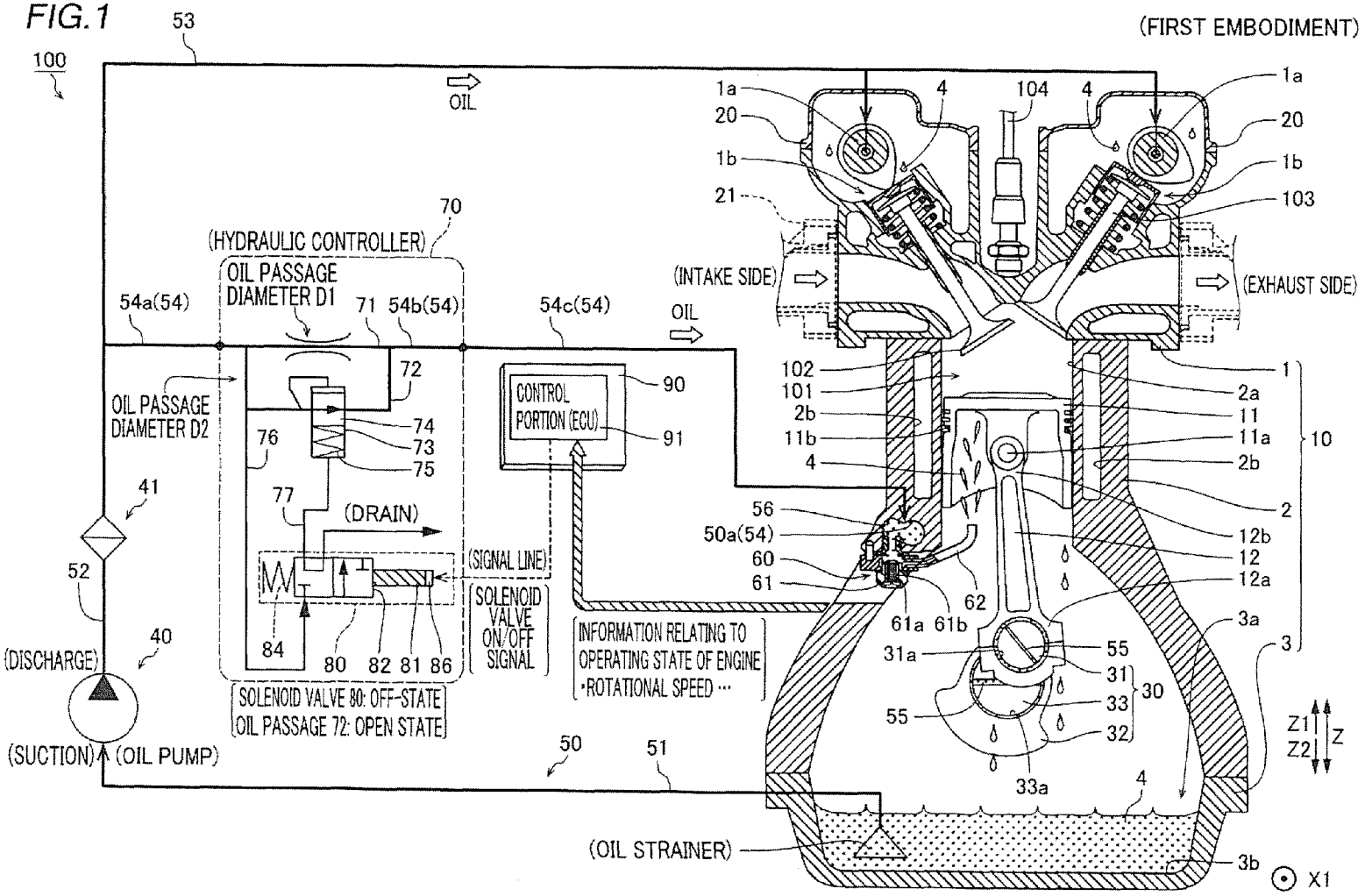
FIG. 1 A diagram schematically showing the overall structure of an engine and a lubricating system provided in the engine according to a first embodiment of the present invention.

The engine 100 for a vehicle (motor vehicle) according to the first embodiment of the present invention includes an engine body 10 made of an aluminum alloy and including a cylinder head 1, a cylinder block 2, and a crank case 3, as shown in FIG. 1. The engine 100 composed of a gasoline engine includes a head cover 20 assembled on the upper side (Z1 side) of the cylinder head 1. The engine 100 is an example of the "internal combustion engine" in the present invention. The engine body 10 is an example of the "internal combustion engine body" in the present invention.

Inside the cylinder head 1, camshafts 1*a*, valve mechanisms 1*b*, etc. are arranged. Inside the cylinder block 2 connected to a lower portion (Z2 side) of the cylinder head 1, cylinders 2*a* in which pistons 11 reciprocate in a direction Z and a water jacket 2*b* surrounding the cylinders 2*a* through a partition wall, through which cooling water (coolant (antifreeze)) for cooling the cylinders 2*a* circulates are formed. Furthermore, on one side (Y2 side) of the cylinder head 1, each of multiple (four) cylinders 2*a* formed in the cylinder block 2 is connected with an air-intake apparatus 21 (shown here by a broken line) that introduces intake air. The camshafts 1*a* and the valve mechanisms 1*b* are examples of the "valve system" in the present invention.

A crank chamber 3*a* is formed in an inner bottom portion of the engine body 10 by the cylinder block 2 and the crank case 3 connected to a lower portion (Z2 side) of the cylinder block 2. In the crank chamber 3*a*, a crankshaft 30 rotatable about an X-axis (a direction perpendicular to the plane) is arranged. In the crankshaft 30, (four) crankpins 31 each having an eccentric rotation axis directly below each cylinder 2*a* and balance weights 32 that hold the respective crankpins 31 therebetween are connected to crank journals 33 that support the crankshaft 30 itself so that the crankshaft 30 is integrated. Large ends 12*a* of con rods 12 are rotatably connected to the crankpins 31, and small ends 12*b* of the con rods 12 are rotatably connected to piston bosses on the back side of the pistons 11. A lower portion (Z2 side) of the crank chamber 3*a* is provided with an oil sump 3*b* in which oil 4 (lubricating oil (engine oil)) is accumulated.

An upper end (Z1 side) of the cylinder block 2 is connected with the cylinder head 1. The cylinder head 1 includes intake valves 102 that take air into combustion chambers 101, exhaust valves 103 that discharge combustion gas, spark plugs 104 that ignite an air-fuel mixture, and injectors (not shown) that supply fuel to the combustion chambers 101. Therefore, in the engine 100, during the intake operation of the pistons 11, the intake valves 102 are opened to take air into the combustion chambers 101, and the injectors supply fuel to the combustion chambers 101. Then, subsequent to the compression operation, the spark plugs 104 ignite and burn air-fuel mixtures of the combustion chambers 101, and an expansion force generated by this burning is conveyed from the pistons 11 to the crankshaft 30. Thus, the engine 100 has a function of taking a drive force from the crankshaft 30.

As shown in FIG. 1, the engine 100 includes an oil pump 40, of which the pump volume is of a constant capacity type, and an oil passage 50 through which the oil pump 40 internally circulates the oil 4. The oil passage 50 includes an oil passage 51 that connects the oil sump 3*b* and the oil pump 40, an oil passage 52 that connects the oil pump 40 and an oil filter 41, an oil passage 53 that connects the oil filter 41 and both the camshafts 1*a* and the valve mechanisms 1*b* (valve system timing members), and an oil passage 54 that connects the oil filter 41 and the crankshaft 30. The oil passage 54 is configured to branch off from the oil passage 53 connected to the oil pump 40.

The continuous oil passage 54 that extends from an upstream side to a downstream side is constituted by an oil passage 54*a* located immediately after branching from the oil passage 53 and downstream of a hydraulic controller 70, an oil passage 54*b* in the hydraulic controller 70, described later, connected to the downstream of the oil passage 54*a*, and an oil passage 54*c* located downstream of the hydraulic controller 70. The oil passages 53 and 54 (oil passages 54*a* to 54*c*) of the oil passage 50 are portions included in an oil gallery 50*a* formed in the cylinder block 2. The oil passage 51, the oil passage 52, and the oil passage 53 are examples of the "first circulation oil passage" in the present invention. The oil passage 51, the oil passage 52, and the oil passage 54 (oil passages 54*a* to 54*c*) are examples of the "second circulation oil passage" in the present invention. The oil passage 54*a* and the oil passage 54*c* are examples of the "upstream oil passage" and the "downstream oil passage" in the present invention, respectively.

Thus, the oil 4 partially flows sequentially through the oil passage 51, the oil passage 52, and the oil passage 53 and is partially supplied to the valve system timing members such as the camshafts 1*a* and the valve mechanisms 1*b* and slide portions such as the outer surfaces of the pistons 11 (the inner surfaces of the cylinders 2*a*). Then, the oil 4 drops by its own weight in the cylinder block 2, and returns to the oil sump 3*b*. The oil 4 also partially flows sequentially through the oil passage 51, the oil passage 52, and the oil passage 54 (oil passages 54*a* to 54*c*) and is also partially supplied to slide portions of the crankshaft 30. Specifically, the oil 4 is supplied to the outer surfaces 31*a* of the crankpins 31 that come into contact with the inner surfaces of the large ends 12*a* of the con rods 12 and the outer surfaces 33*a* of the crank journals 33 rotatably supported in the cylinder block 2. Then, the oil 4 drops from the slide portions of the crankshaft 30 by its own weight, and returns to the oil sump 3*b*.

FIG. 1 schematically shows the oil passage 50 (oil passages 51 to 54) through which the oil 4 circulates and the hydraulic controller 70 described later as a hydraulic circuit diagram, unlike a schematic sectional view of the engine body 10, for convenience of illustration. Actually, the oil passage 50 is mostly constituted by the oil gallery 50*a* formed in the cylinder block 2. According to the first embodiment, the overall structural illustration of the oil gallery 50*a* is omitted in order to illustrate the structure and operation of the hydraulic controller 70 incorporated in a portion of the oil passage 50. The oil pump 40, the oil filter 41, and the oil passages 51 to 54 including the hydraulic controller 70 are illustrated as planar in a left region of the engine body 10 in the figure so that the overall structure of the engine 100 is shown. The hydraulic controller 70 is an example of the "hydraulic controller for an internal combustion engine" in the present invention.

The oil passage 54 is divided into multiple oil passages 55 formed in the crankshaft 30 and oil passages 56 connected to oil jets 60 on the downstream side (in the oil gallery 50*a*) of the oil passage 54*c*. Each of the oil passages 55 branching off from the oil passage 54 (oil passage 54*c*) is opened to the outer surfaces 31*a* of the crankpins 31 and the outer surfaces 33*a* of the crank journals 33.

Downstream ends (openings) of the oil passages 56 are mounted with the oil jets 60. The oil jets 60 have a function of supplying (squirting) the oil 4 for cooling to the back sides of the pistons 1 by operating (opening valves) at an operating pressure Pj (see FIG. 5). More specifically, the oil jets 60 include valve portions 61 that switch flow passages (oil passages 56) to open states (flowable states) when the oil pressure reaches at least the operating pressure Pj and nozzle portions 62 that extend obliquely upward from the outlet sides of the valve portions 61 toward the cylinders 2*a*. Valve bodies 61*b* of the valve portions 61 normally close the oil passages 56 by urging forces (stretching forces) of springs 61*a*. The oil passages 56 are opened when the valve bodies 61*b* are pushed down against the stretching forces of the springs 61*a* with increasing the oil pressure. Thus, the oil 4, of which the pressure has reached at least the operating pressure Pj is continuously squirted upward from tip ends (Z1 sides) of the nozzle portions 62. An oil jet 60 is provided for each of the four cylinders 2*a*. The operating pressure Pj is an example of the "predetermined operating pressure" in the present invention.

Figure 3:
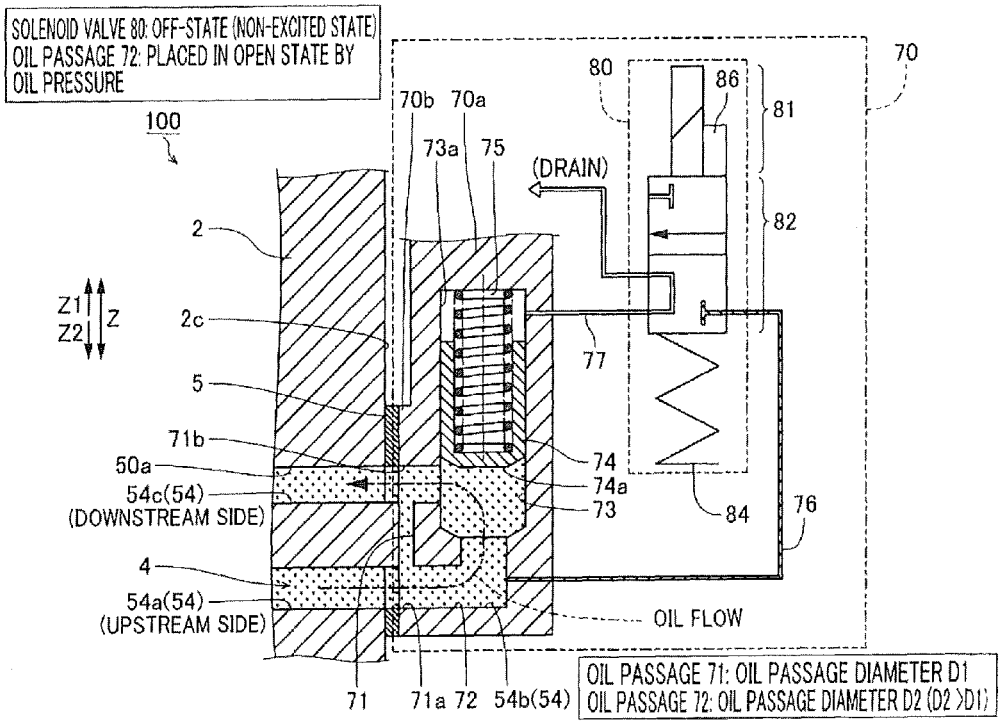
FIG. 3 A diagram schematically showing the internal structure of the hydraulic controller mounted on the engine according to the first embodiment of the present invention.

According to the first embodiment, the hydraulic controller 70 is incorporated in the oil passage 54 connected with both the oil passages 55 and the oil passages 56. The hydraulic controller 70 is mounted on a side surface portion 2*c* of the cylinder block 2 to which a halfway portion of the oil gallery 50*a* (oil passage 54) is opened, as shown in FIG. 3. More specifically, the hydraulic controller 70 is provided on the upstream side of the oil passage 54*c* including the oil jets 60, as shown in FIG. 1. The structure of the hydraulic controller 70 is described below in detail.

Figure 2:
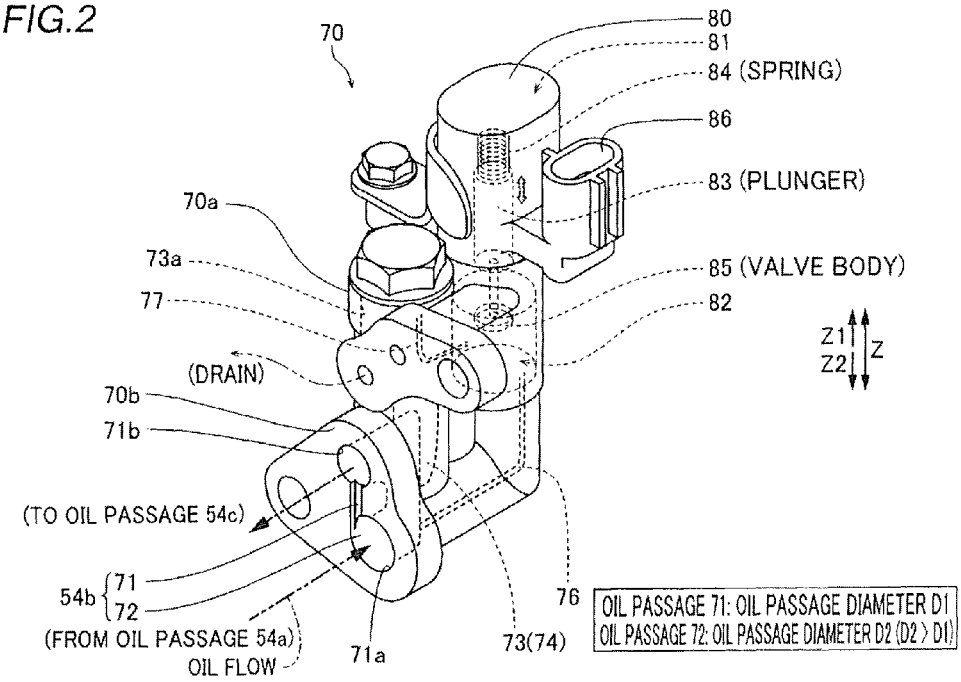
FIG. 2 A perspective view showing the structure of a hydraulic controller mounted on the engine according to the first embodiment of the present invention.

The hydraulic controller 70 includes a main body 70*a* made of an aluminum alloy and a solenoid valve 80 mounted on a top portion (Z1 side) of the main body 70*a*, as shown in FIG. 2. As shown in FIGS. 2 and 3, inside the main body 70*a*, an oil passage 71 and an oil passage 72 are formed. Specifically, a mounting surface 70*b* of the main body 70*a* on the cylinder block 2 (see FIG. 1) in the engine body 10 is formed with an opening 71*a*, which serves as an inlet side (upstream side), and an opening 71*b*, which serves as an outlet side (downstream side). As shown in FIG. 3, in a state where the hydraulic controller 70 is not mounted on the side surface portion 2*c* of the cylinder block 2, an end of each of the oil passage 54*a* (upstream side) and the oil passage 54*c* (downstream side) closer to the side surface portion 2*c* is opened to the outside. As shown in FIGS. 1 and 3, the oil passage 54*a* is connected to the opening 71*a* of the mounting surface 70*b* of the hydraulic controller 70, and the oil passage 54*c* (downstream side) is connected to the opening 71*b* of the mounting surface 70*b*. Thus, the oil passage 54*a* and the oil passage 54*c* are configured to be communicated with each other through the hydraulic controller 70.

The oil passage 71 is formed in a tube shape by a groove-like portion linearly connecting the opening 71*a* and the opening 71*b* along the mounting surface 70*b* and the side surface portion 2*c* of the cylinder block 2 that faces the mounting surface 70*b* when the mounting surface 70*b* is mounted on the cylinder block 2 through a gasket 5 for an oil seal. The oil passage 71 is configured as a fixed restrictor in a constantly open state, having an oil passage diameter D1. The oil passage 71 is used when the oil 4, of which the oil pressure has been suppressed to an oil pressure lower than the operating pressures Pj (the urging forces of the springs 61*a*) at the valve portions 61 (see FIG. 1) of the oil jets 60, is supplied to portions of the oil passages 56 connected with the oil jets 60. In this case, the oil pressure does not reach the operating pressure Pj so that the valve portions 61 are not opened, and hence the oil 4 is not squirted from the oil jets 60. On the other hand, the oil 4 flows only through the oil passages 55, and is supplied only to the crankshaft 30. The oil passages 71 and 72 are examples of the "first passage" and the "second passage" in the present invention, respectively. The oil passage 72 is an example of the "bypass passage" in the present invention. The solenoid valve 80 is an example of the "opening-closing control portion" or the "first solenoid valve" in the present invention. The oil passage diameter D1 is an example of the "first oil passage diameter" in the present invention.

As shown in FIGS. 2 and 3, the oil passage 72 is formed at the back (on the inner side of the main body 70*a*) of the oil passage 71 through the opening 71*a* and the opening 71*b*. The oil passage 72 has an oil passage diameter D2, which is larger than the oil passage diameter D1 in an open state. The oil passage 72 is used when the oil 4, of which the oil pressure has reached an oil pressure higher than the operating pressures Pj (the urging forces of the springs 61*a*) at the valve portions 61 (see FIG. 1) of the oil jets 60, is supplied to the nozzle portions 62 of the oil jets 60. More specifically, the oil passage 72 serves as an openable and closable bypass passage having the oil passage diameter D2 larger than the oil passage diameter D1. Therefore, the hydraulic controller 70 is provided with the single (common) oil passage 54*b* including the oil passage 71 and the oil passage 72. A valve body storing portion 73 extending upward (in an arrow Z1 direction) such that the inner surface of the oil passage 72 is cylindrically recessed is formed halfway in the oil passage 72 that connects the opening 71*a* and the opening 71*b* in a C-shape. The oil passage diameter D2 is an example of the "second oil passage diameter" in the present invention.

In the valve body storing portion 73, a valve body 74 slidable in a vertical direction and a coiled spring 75 that constantly urges the valve body 74 toward the closed position (Z2 side) of the oil passage 72 are arranged. Therefore, when the valve body 74 is pushed up against the urging force (stretching force) of the spring 75 according to the operation of the solenoid valve 80 described later, the oil passage 72 is opened so that the oil 4 can flow through the oil passage 72. Thus, the oil passage 71 in a constantly open state and the oil passage 72 openable/closable according to the on/off operation of the solenoid valve 80 are arranged alongside of each other in the main body 70*a*.

The directly actuated solenoid valve 80 includes a solenoid portion 81 and a main valve portion 82. The main body 70*a* and the main valve portion 82 are connected to each other by an oil passage 76 and an oil passage 77. The oil passage 76 communicates the oil passage 72 and a flow-in port (primary side) of the main valve portion 82 with each other, and the oil passage 77 communicates a flow-out port (secondary side) of the main valve portion 82 and a back side portion 73*a* (a side of the valve body 74 in the valve body storing portion 73, into which the spring 75 is fitted) of the valve body storing portion 73 with each other. Structurally, in the solenoid valve 80, a plunger (iron piece) 83 is arranged at the center of the solenoid portion 81, as shown in FIG. 2, and this plunger 83 pushes a valve body 85 in the main valve portion 82 by the urging force (stretching force) of a spring 84. Thus, in a non-excited state, the valve body 85 closes communication of the oil passage 76 with the oil passage 77. When the solenoid portion 81 is excited, the plunger 83 is lifted (the spring 84 itself is compressed) against the stretching force of the spring 84, and the valve body 85 reaches a state where a closed state between the oil passage 76 and the oil passage 77 is released. More specifically, the main valve portion 82 terminates a connection between the oil passage 76 and the oil passage 77 (is of a normal close type) when the solenoid portion 81 is non-excited (non-energized), but the main valve portion 82 has a function of communicating the oil passage 76 and the oil passage 77 with each other when the solenoid portion 81 is excited (energized). When the solenoid portion 81 is non-excited (non-energized), the oil passage 77 is open to an atmosphere pressure side (the pressure side of the crank chamber 3*a* (see FIG. 1)) through the main valve portion 82. FIG. 1 shows a state where the solenoid valve 80 is non-excited (a normal close state).

As shown in FIG. 1, the solenoid valve 80 includes a connector portion 86 electrically connected to the solenoid portion 81. The connector portion 86 is connected with a line (signal line: shown by a two-dot chain line in FIG. 1) that extends from a control circuit portion 90. The solenoid valve 80 is configured such that electric power is supplied to the solenoid portion 81 on the basis of a command from a control portion (ECU) 91 provided in the control circuit portion 90. Thus, according to the first embodiment, in a state where the engine 100 operates so that the oil pump 40 is driven, two ways of flowing can be generated in the oil 4 that flows through the oil passage 54 (strictly speaking, a portion corresponding to the oil passage 54*b*) by control of switching between excitation and non-excitation of the solenoid portion 81. FIG. 1 shows a state where the solenoid valve 80 is turned off (non-excited.

As shown in FIG. 3, in a state where electric power supply to the solenoid valve 80 is stopped so that the solenoid portion 81 is non-excited, the plunger 83 (see FIG. 2) is pushed down by the stretching force of the spring 84, and the valve body 85 (see FIG. 2) in the main valve portion 82 is moved to a position at which the valve body 85 closes communication of the oil passage 76 with the oil passage 77. Thus, the oil 4 that flows in through the opening 71*a* is not supplied to beyond the oil passage 76. The valve body 74 is pushed upward (in the arrow Z1 direction) against the pushing force of the spring 75 by the oil 4, of which the oil pressure acts also on a pressure receiving surface 74*a*. Thus, the oil passage 72 is opened. The space volume of the back side portion 73*a* is reduced along with upward movement of the valve body 74 (compression of the spring 75), but the oil 4 accumulated in preceding control is discharged through the oil passage 77 and the main valve portion 82, and eventually returns to the oil sump 3*b*. Thus, the oil 4 that flows in through the opening 71*a* flows through the oil passage 72 in addition to the oil passage 71 in a constantly open state, and returns to the oil gallery 50*a* (oil passage 54) through the opening 71*b*. More specifically, in a state where the solenoid valve 80 is turned off, the oil passage 72 (oil passage diameter D2) is opened, and the oil 4 flows through both the oil passage 71 and the oil passage 72. Thus, the oil passage 72 is controlled to be in an open state when the solenoid valve 80 is non-energized (non-excited).

Figure 4:
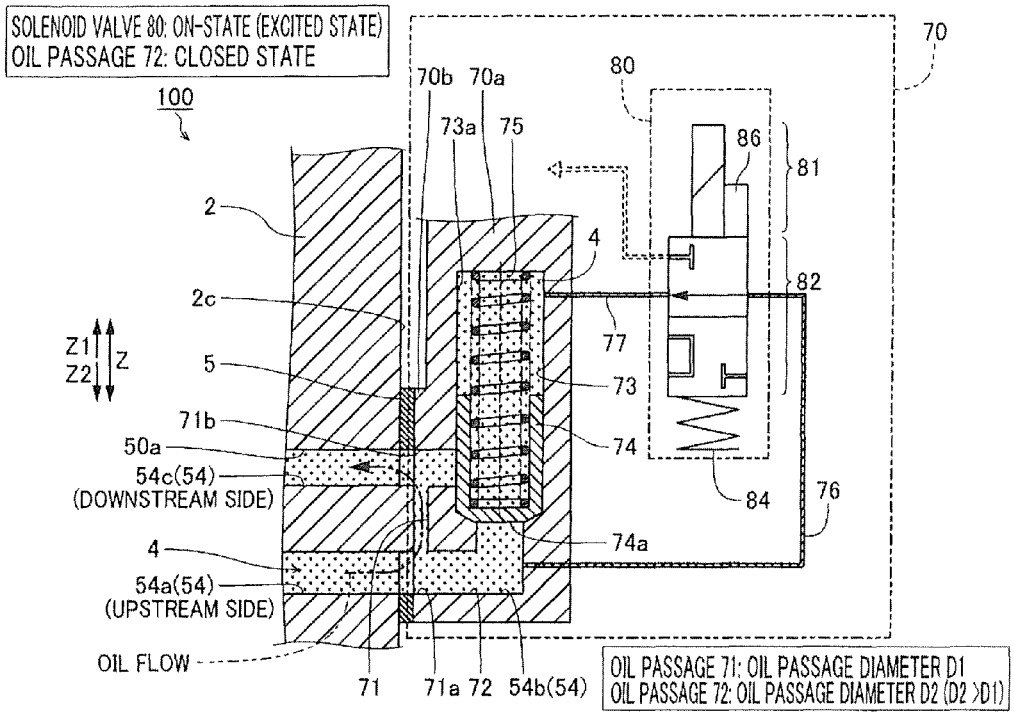
FIG. 4 A diagram schematically showing the internal structure of the hydraulic controller mounted on the engine according to the first embodiment of the present invention.

As shown in FIG. 4, in a state where the solenoid portion 81 is excited on the basis of electric power supply from the control circuit portion 90 (see FIG. 1), the oil passage 76 and the oil passage 77 are connected to each other by the operation of the main valve portion 82 performed by the solenoid portion 81. More specifically, the plunger 83 (see FIG. 2) is lifted, and the valve body 85 (see FIG. 2) is moved to a position at which the valve body 85 allows the oil passage 76 and the oil passage 77 to be communicated with each other. Thus, the oil 4 that flows in through the opening 71*a* connected to the oil gallery 50*a* (oil passage 54*a*) is supplied also to the back side portion 73*a* of the valve body storing portion 73 through the oil passage 76 and the oil passage 77. The back side portion 73*a* is filled with the oil 4, and the valve body 74 is slid downward (in a direction Z2) by the oil pressure to close the oil passage 72. The oil 4 that flows in through the opening 71*a* acts also on the pressure receiving surface 74*a* of the valve body 74, but a force for pushing down the valve body 74 is increased by the stretching force of the spring 75 at the back side portion 73*a*, and hence the valve body 74 is moved downward to close the oil passage 72. Thus, the oil 4 that flows in through the opening 71*a* flows only through the oil passage 71 (oil passage diameter D1) in a constantly open state, and returns to the oil gallery 50*a* (oil passage 54) through the opening 71*b*. More specifically, in a state where the solenoid valve 80 is turned on, the oil passage 72 is closed, and the oil 4 flows only through the oil passage 71.

According to the first embodiment, in the state of FIG. 4 in which the solenoid portion 81 is excited, the oil 4 flows only through the oil passage 71 having an oil passage diameter D1 and forming a fixed restrictor, and hence in a state where the oil pressure of the oil 4 is reduced, the oil 4 is supplied to the downstream side (the oil passage 54*c*, the oil passages 55, and the oil passages 56) of the oil gallery 50*a*. Therefore, in a state where the oil pressure is reduced to a pressure lower than the operating pressures Pj (the urging forces of the springs 61*a*) at the valve portions 61 (see FIG. 1) of the oil jets 60, the oil 4 is supplied only to slide portions around the crankshaft 30 through the oil passages 55. More specifically, when the oil passage 72 is controlled to be in a closed state by control of turning on the solenoid valve 80, the oil jets 60 stop operating.

In the state of FIG. 3 in which the solenoid portion 81 is non-excited (turned off), on the other hand, the valve body 74 is pushed up by the oil pressure to open the oil passage 72, and hence the oil 4 is supplied to the downstream side (the oil passage 54*c*, the oil passages 55, and the oil passages 56) of the oil gallery 50*a* while maintaining an oil pressure (an oil pressure that flows only through the oil passage 71 of the hydraulic controller 70 and is not reduced) according to the rotational speed of the engine 100 (crankshaft 30). At this time, the oil 4, of which the oil pressure has reached at least the urging forces (at least the operating pressures Pj) of the springs 61*a*, pushes down the valve portions 61 (see FIG. 1) of the oil jets 60 in the oil passages 56. More specifically, in the oil jets 60, the valve portions 61 are pushed down so that oil passages in the oil jets 60 are opened. Therefore, the oil 4 is supplied not only to the crankshaft 30 that rotates in a high rotational speed range but also to the oil jets 60 in a state where the oil pressure (at least the operating pressures Pj) is maintained at a correspondingly high level. In the oil jets 60, the oil 4, of which the oil pressure has reached at least the operating pressures Pj, is squirted upward from the tip ends (Z1 sides) of the nozzle portions 62. More specifically, the oil jets 60 are actuated when the oil passage 72 is controlled to be in an open state by control of turning off the solenoid valve 80, as shown in FIG. 1.

Thus, in the engine 100, the hydraulic controller 70 (the main valve portion 82 and the valve body 74) is actuated by control of turning on (energizing) or off (non-energizing) the solenoid valve 80, whereby the oil passage 72 can be opened or closed under predetermined conditions during the operation of the engine 100. The oil passage 72 switches between an open state and a close state, whereby control (control of turning on or off the oil jets 60) regarding the operation of the oil jets 60 can be achieved by varying the resistance of the continuous oil passage 54 (strictly speaking, the portion corresponding to the oil passage 54*b*) including the hydraulic controller 70.

According to the first embodiment, control of turning on or off the solenoid valve 80 (see FIG. 1) is performed under the following conditions.

Specifically, when at least one of a condition where the rotational speed of the crankshaft 30 (engine 100) has reached at least a prescribed value Rj (rotation/minute) during the operation of the engine 100 and a condition where the temperatures (estimated temperatures) of the pistons 11 (see FIG. 1) have reached more than a prescribed value Tj (° C.) is satisfied, the excited solenoid portion 81 (the oil passage 72 is closed) of the solenoid valve 80 (see FIG. 4) is controlled to be non-excited (non-energized) on the basis of a command from the control portion 91 so that the oil passage 72 is opened (see FIG. 3). The prescribed value Tj and the prescribed value Rj are examples of the "predetermined temperature" and the "predetermined rotational speed" in the present invention, respectively.

More specifically, when the rotational speed of the engine 100 is less than the prescribed value Rj or the temperatures (estimated temperatures) of the pistons 11 estimated on the basis of the rotational speed are less than the prescribed value Tj, the excited state of the solenoid valve 80 is maintained, and the oil passage 72 is maintained to be in a closed state (see FIG. 4). Therefore, in this case, the oil 4 narrowed by only the oil passage 71 is supplied only to the slide portions around the crankshaft 30 only through the oil passages 55 (the oil jets 60 stop operating). When the rotational speed of the engine 100 is at least the prescribed value Rj or the temperatures (estimated temperatures) of the pistons 11 are at least the prescribed value Tj, the solenoid valve 80 is turned off, and the oil passage 72 is switched to an open state (see FIG. 3). Therefore, in this case, the oil 4 that mainly flows through the oil passage 72, which serves as a bypass passage, is supplied not only through the oil passages 55 but also through the oil passages 56 to the nozzle portions 62 of the oil jets 60. Thus, the oil 4 is squirted from the nozzle portions 62, and the pistons 11 are cooled.

In the engine 100, the oil passage 72 is controlled to be in an open state when the solenoid valve 80 is in an off-state (non-excited). Thus, when the solenoid valve 80 is broken down and is constantly in an off-state (non-exited), in the hydraulic controller 70, the oil passage 72 is opened, and hence the oil 4 is reliably supplied to the back sides of the pistons 11 through the oil passage 72 even when the engine 100 shifts to a high load (high rotational speed range) so that the oil pressure is increased. During a period in which the engine 100 operates for a long time and it is necessary to cool the pistons 11, electric power supply to the solenoid valve 80 is stopped, and hence power consumption used to control the hydraulic controller 70 (solenoid valve 80) is reduced.

Figure 5:
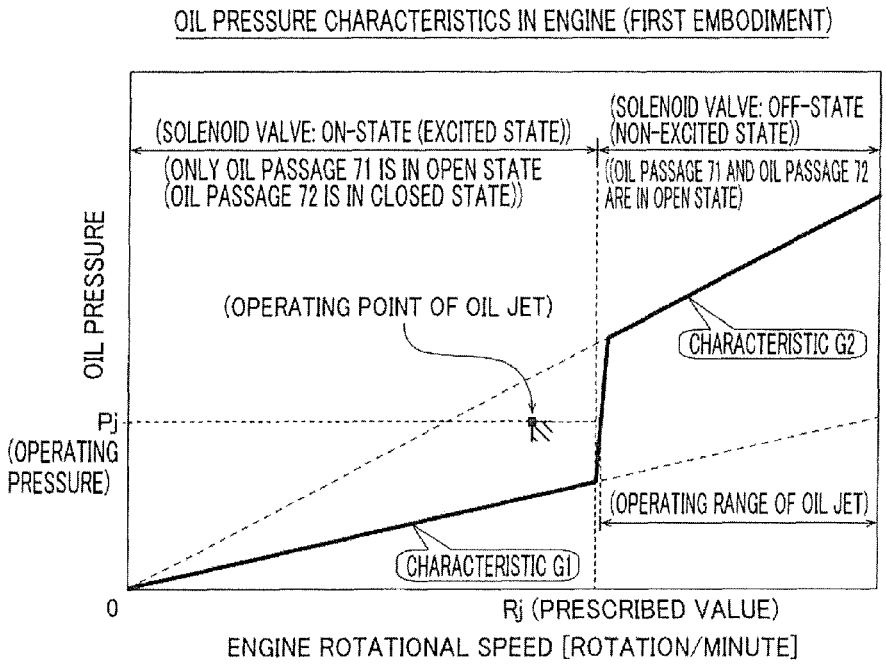
FIG. 5 A diagram showing oil pressure characteristics in the engine according to the first embodiment of the present invention.

As an example of oil pressure control characteristics in the engine 100, characteristics of the oil pressure (vertical axis) at the oil passage 54 with respect to the rotational speed (horizontal axis) of the engine 100 are shown in FIG. 5.

As shown in FIG. 5, when the engine 100 (see FIG. 1) operates in a low rotational speed range, the rotational speed of the oil pump 40 (see FIG. 1) is increased with increasing the rotational speed, and hence the discharge pressure of the oil 4 is also increased. In this case, in the hydraulic controller 70, the solenoid valve 80 is in an excited state (the solenoid portion 81 is in an energized state). More specifically, the hydraulic controller 70 is in the state shown in FIG. 4, and the oil passage 72 is closed by the valve body 74. Thus, the oil 4 flows only through the oil passage 71, and is supplied only to the side of the crankshaft 30 in a state where the oil pressure is reduced by the oil passage 71. Therefore, in a state where the solenoid valve 80 is excited, an oil pressure characteristic with respect to the engine rotational speed is shown as a characteristic G1.

Then, assume that a load has been applied to the engine 100 (see FIG. 1) so that the rotational speed of the engine 100 has reached a predetermined rotational speed (prescribed value Rj). In this case, in the hydraulic controller 70, the solenoid valve 80 is switched to a non-excited state (the solenoid portion 81 is non-energized). More specifically, the hydraulic controller 70 shifts to the state shown in FIG. 3, and the valve body 74 goes in reverse upward so that the oil passage 72 is opened. Thus, the oil 4 mostly flows not only through the oil passage 71 but also through the oil passage 72, and is supplied to the crankshaft 30 and the oil jets 60. In the hydraulic controller 70, the oil 4 is no longer narrowed, and hence the oil pressure of the oil 4 is significantly increased with increasing the rotational speed of the oil pump 40. Therefore, in a state where the engine rotational speed has reached at least the prescribed value Rj and the solenoid valve 80 is non-excited, an oil pressure characteristic with respect to the engine rotational speed is shown as a characteristic G2. Immediately after the solenoid valve 80 is non-excited, the oil pressure is larger than an oil pressure (operating pressure Pj) at which the oil jets 60 can operate. Therefore, the oil 4 is swiftly squirted from the oil jets 60.

Control of switching from the excited state of the solenoid valve 80 to the non-excited state of the solenoid valve 80 is performed when the temperatures of the pistons 11 (see FIG. 1) estimated from the engine rotational speed have reached more than the prescribed value Tj (° C.), as described above, in addition to when the engine rotational speed has reached the prescribed value Rj. When the engine rotational speed is less than the prescribed value Rj or the temperatures of the pistons 11 estimated from the engine rotational speed are not more than the prescribed value Tj (° C.), on the other hand, the solenoid valve 80 remains to be excited, and the oil jets 60 are not actuated. This is because the oil passage 72 is closed so that oil supply to the back sides of the pistons 11 is stopped when the engine rotational speed remains in the low rotational speed range such as immediately after the start of the engine 100 or when the oil pressure is temporarily increased due to an oil viscosity at a low oil temperature such as immediately after the start of the engine 100 (upon cold engine start). Particularly, the oil 4 is not supplied (squirted) to the back sides of the pistons 11 at the low oil temperature, and hence leakage of the oil 4 from clearance gaps between internal walls of the cylinders 2*a* and piston rings 11*b* to the sides of the combustion chambers 101 and burning of the oil 4 are suppressed. The engine 100 according to the first embodiment is configured as described above.

A processing flow of oil pressure control performed by the control portion (ECU) 91 in the engine 100 according to the first embodiment is now described with reference to FIGS. 1 to 6.

Figure 6:
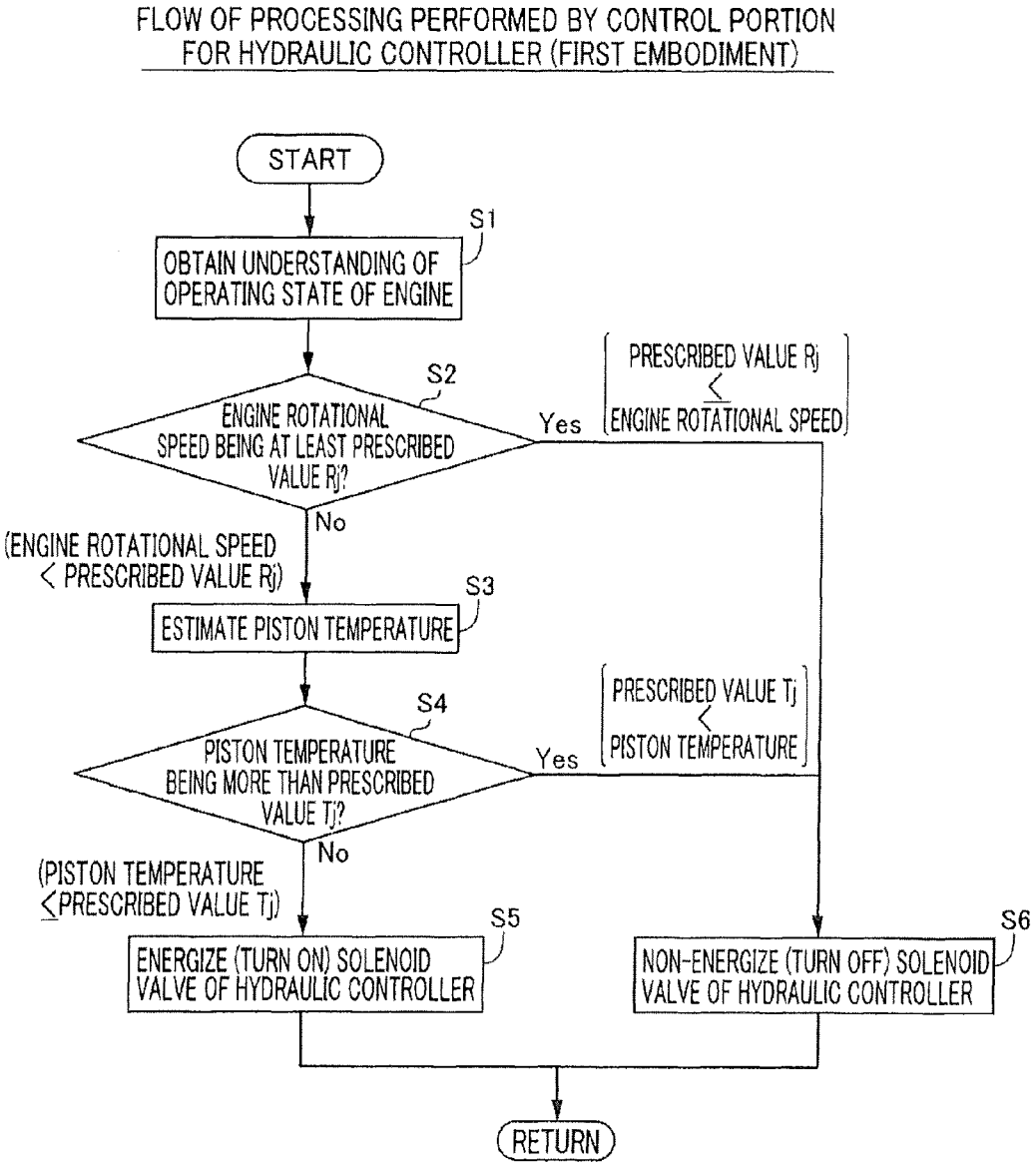
FIG. 6 A diagram showing a control flow for hydraulic control performed by a control portion (ECU) in the engine according to the first embodiment of the present invention.

First, at a step S1, the control portion 91 (see FIG. 1) obtains an understanding of the operating state of the engine 100 (see FIG. 1), as shown in FIG. 6. More specifically, the rotational speed of the crankshaft 30 (see FIG. 1) (hereinafter referred to as the engine rotational speed) is detected. Then, at a step S2, the control portion 91 determines whether or not the engine rotational speed is at least the prescribed value Rj (rotation/minute).

When determining that the engine rotational speed is less than the prescribed value Rj at the step S2, the control portion 91 advances to a step S3, but when determining that the engine rotational speed is at least the prescribed value Rj, the control portion 91 advances to a step S6 described later.

When it is determined that the engine rotational speed is less than the prescribed value Rj, the temperatures of the pistons 11 (see FIG. 1) are estimated on the basis of the engine rotational speed at the step S3. At a step S4, the control portion 91 determines whether or not the temperatures (estimated temperatures) of the pistons 11 are more than the prescribed value Tj. When determining that the temperatures (estimated temperatures) of the pistons 11 are not more than the prescribed value Tj at the step S4, the control portion 91 advances to a step S5, but when determining that the temperatures (estimated temperatures) of the pistons 11 are more than the prescribed value Tj, the control portion 91 advances to a step S6 described later.

When it is determined that the temperatures (estimated temperatures) of the pistons 11 are not more than the prescribed value Tj at the step S4, the solenoid valve 80 of the hydraulic controller 70 is placed in an energized state (on-state) on the basis of a command from the control portion 91 at the step S5, and then this control flow is terminated. In this case, the oil passage 76 and the oil passage 77 are communicated with each other by the operation of the main valve portion 82 performed by the solenoid portion 81 in a state where the solenoid portion 81 is excited on the basis of electric power supply from the control circuit portion 90 (see FIG. 1), as shown in FIG. 4. More specifically, the plunger 83 (see FIG. 2) is lifted against the spring 84 (see FIG. 2), and the valve body 85 (see FIG. 2) is moved to the position at which the valve body 85 allows the oil passage 76 and the oil passage 77 to be communicated with each other. Thus, the oil 4 that flows in through the opening 71*a* connected to the oil gallery 50*a* (oil passage 54) is supplied to the back side portion 73*a* of the valve body storing portion 73 through the oil passage 76 and the oil passage 77. Then, the back side portion 73*a* is filled with the oil 4, and the valve body 74 is slid downward (in the direction Z2) to close the oil passage 72. The oil 4 that flows in through the opening 71*a* acts also on the oil receiving surface 74*a* of the valve body 74, but a force for pushing down the valve body 74 is increased by the stretching force of the spring 75 at the back side portion 73*a*, and hence the valve body 74 is moved downward to close the oil passage 72. Thus, the oil 4 that flows in through the opening 71*a* flows only through the oil passage 71 (oil passage diameter D1) in a constantly open state, and returns to the oil gallery 50*a* (oil passage 54). After the termination of this control flow, this control flow shown in FIG. 6 is performed again after the elapse of a predetermined control cycle. In a state where the steps S1 to S5 are repeated, an oil pressure characteristic that varies with increasing the rotational speed is shown as the characteristic G1 in FIG. 5.

When it is determined that the engine rotational speed is at least the prescribed value Rj at the step S2 and when it is determined that the temperatures (estimated temperatures) of the pistons 11 are more than the prescribed value Tj at the step S4 (when it is determined that the rotational speed of the crankshaft 30 is not at least the prescribed value Rj and the temperatures of the pistons 11 are more than the prescribed value Tj), as shown in FIG. 6, the solenoid valve 80 is placed in an non-energized state (off-state) at the step S6, and then this control flow is terminated. More specifically, in a state where electric power supply is stopped so that the solenoid portion 81 is non-excited, as shown in FIG. 3, the plunger 83 (see FIG. 2) is pushed down by the stretching force of the spring 84 (see FIG. 2), and the valve body 85 (see FIG. 2) in the main valve portion 82 is moved to the position at which the valve body 85 closes communication of the oil passage 76 with the oil passage 77. Thus, the oil 4 that flows in through the opening 71*a* is not supplied to beyond the oil passage 76. The valve body 74 is pushed upward (in the arrow Z1 direction) against the pushing force of the spring 75 by the oil 4, of which the oil pressure acts also on the pressure receiving surface 74*a*. Thus, the oil passage 72 is opened. The space volume of the back side portion 73*a* is reduced along with upward movement of the valve body 74 (compression of the spring 75), but the oil 4 accumulated until then is discharged through the oil passage 77 and the main valve portion 82, and returns to the oil sump 3*b* (see FIG. 1). Thus, the oil 4 that flows in through the opening 71*a* flows through the oil passage 72 in addition to the oil passage 71 in a constantly open state, and returns to the oil gallery 50*a* (oil passage 54).

When it is determined that the engine rotational speed is at least the prescribed value Rj at the step S2, the solenoid valve 80 is immediately placed in an non-excited state (off-state) at the step S6. This is a state where an appropriate load is applied to the engine 100 when the engine rotational speed is at least the prescribed value Rj, and therefore the temperatures of the pistons 11 are not estimated but exceed the prescribed value Tj. Therefore, when it is determined that the engine rotational speed is at least the prescribed value Rj at the step S2, the solenoid valve 80 is unambiguously non-energized (non-excited) so that the oil passage 72 is opened. After the termination of this control flow, this control flow shown in FIG. 6 is performed again after the elapse of the predetermined control cycle. In a state where the flow of the steps S1 and S6 and the flow of the steps S1 to S4 and S6 are repeated, the oil pressure characteristic that varies with increasing the rotational speed is shown as the characteristic G2 in FIG. 5. In this manner, the control portion 91 controls the hydraulic controller 70 during the operation of the engine 100.

According to the first embodiment, the following effects can be obtained.

According to the first embodiment, as hereinabove described, the hydraulic controller 70 including the oil passage 71 in a constantly open state, through which the oil 4 having a pressure lower than the operating pressure Pj is supplied to the oil jets 60, the oil passage 72 provided alongside of the oil passage 71 and being openable and closable, through which the oil 4 having a pressure higher than the operating pressure Pj is supplied to the oil jets 60 in combination with the oil passage 71 in a state where the oil passage 72 is opened, and the solenoid valve 80 that controls the oil passage 72 to be in an open state when actuating the oil jets 60, and controls the oil passage 72 to be in a closed state when stopping actuating the oil jets 60 is provided upstream of the oil passage 54 including the oil jets 60. Thus, during a period in which the oil passage 72 is closed, the oil 4 (lubricating oil), of which the oil pressure has been reduced to less than the operating pressure Pj, can be continuously supplied to the downstream side (the oil passages 55 and the oil passages 56) of the oil passage 54 including the oil jets 60 only through the oil passage 71 in a constantly open state. Only when the oil passage 72 is opened, the oil 4 can be reliably supplied to the oil jets 60 through the oil passage 71 and the oil passage 72. More specifically, a function of supplying the oil 4 only to the crankshaft 30 or the like constantly requiring the oil 4 during the operation of the engine 100 and a function of supplying the oil 4 to the back sides of the pistons 11 by opening the oil passage 72 when the engine 100 shifts to the high load (high rotational speed range) so that the oil pressure is increased can be properly used as the situation demands with the hydraulic controller 70 including the single (common) oil passage 54*b* including the oil passage 71 and the oil passage 72 and the solenoid valve 80. Therefore, simply by adding the hydraulic controller 70 to the existing oil gallery 50*a* through which the oil 4 is supplied to the crankshaft 30 and the pistons 11, for example, the oil jets 60 can be actuated as needed while the oil 4 is constantly supplied to the crankshaft 30. Thus, it is not necessary to separately provide a dedicated sub oil passage (sub oil gallery) for supplying the oil 4 from a main oil passage (main oil gallery) in the cylinder block 2 to the oil jets 60, provide a solenoid valve or the like for opening and closing control in the sub oil passage (sub oil gallery), and switch a supply destination of the oil 4 according to the state of the engine. Consequently, it is not necessary to provide the dedicated sub oil passage (sub oil gallery), and hence the back sides of the pistons 11 can be properly cooled by the oil 4 (lubricating oil) with a simple oil passage structure including the commonalized oil passage 54*b*.

According to the first embodiment, the oil passage 72 is controlled to be in a closed state by the solenoid valve 80 when the oil jets 60 stop operating, whereby the oil passage 72 is closed so that oil supply to the back sides of the pistons 11 can be stopped even when the oil pressure is temporarily increased due to the oil viscosity at the low oil temperature such as immediately after the start of the engine 100 (upon cold engine start). Therefore, leakage of the oil 4 from the clearance gaps between the internal walls of the cylinders 2*a* and the piston rings lib to the sides of the combustion chambers 101 and burning of the oil 4 caused by supply (squirt) of the oil 4 to the backs sides of the pistons 11 at the low oil temperature can be suppressed. Thus, in addition to cooling of the back sides of the pistons 11, oil supply to the back sides of the pistons 11 is stopped with a simple oil passage structure including the commonalized oil passage 54 so that deterioration of the quality of exhaust gas caused by burning of the oil 4 can be properly suppressed.

According to the first embodiment, the oil passage 71 is configured as a fixed restrictor in a constantly open state, having the oil passage diameter D1, and the oil passage 72 is configured as an openable and closable bypass passage having the oil passage diameter D2 larger than the oil passage diameter D1. Thus, the oil 4 (lubricating oil), of which the oil pressure has been reduced to less than the operating pressure Pj, can be continuously supplied to the downstream side (the oil passages 55 and the oil passages 56) of the oil passage 54*c* including the oil jets 60 through the oil passage 71, to which a predetermined resistance (flow passage resistance) is applied, by the fixed restrictor having the oil passage diameter D1 in the single (common) oil passage 54*c* including the oil passage 71 and the oil passage 72. Furthermore, the bypass passage having the oil passage diameter D2 larger than the oil passage diameter D1 of the oil passage 72 is opened, whereby the oil 4 can be easily supplied also to the oil jets 60 connected to the downstream side (the oil passages 55 and the oil passages 56) of the oil passage 54*c* in a state where the oil passage 54*b* is switched to a resistance (flow passage resistance) smaller than that of the fixed restrictor of the oil passage 71.

According to the first embodiment, the solenoid valve 80 connected to the oil passage 72 is used to control opening and closing of the oil passage 72. Thus, the opening and closing operation of the oil passage 72 to be controlled (driven) by the solenoid valve 80 can be easily performed by effectively utilizing the opening and closing operation of a drive valve, of which the response speed is fast, using the electromagnetic force of an electromagnet (solenoid portion 81). Furthermore, a solenoid valve 80 capable of retaining only one of a fully open state and a fully closed state is used as the solenoid valve 80, whereby the opening and closing operation (control of switching between start and stop of the oil jets 60) of the oil passage 72 in the hydraulic controller 70 can be reliably performed.

According to the first embodiment, the oil passage 72 is controlled to be in an open state when the solenoid valve 80 is non-energized (non-excited). Thus, when the solenoid valve 80 is broken down and is constantly in a non-energized (non-exited) state, in the hydraulic controller 70, the oil passage 72 is constantly opened, and hence the oil 4 can be reliably supplied to the back sides of the pistons 11 through the oil passage 72 even when the engine 100 shifts to the high load (high rotational speed range) so that the oil pressure is increased. Furthermore, during the period in which the engine 100 operates for a long time and it is necessary to cool the pistons 11, electric power supply to the solenoid valve 80 can be stopped, and hence power consumption used to control the hydraulic controller 70 (solenoid valve 80) can be reduced.

According to the first embodiment, the engine body 10 (cylinder block 2) provided with the oil passage 54*a* located upstream of the hydraulic controller 70 and the oil passage 54*c* located downstream of the hydraulic controller 70 and including the side surface portion 2*c* on which the end of each of the oil passage 54*a* and the oil passage 54*c* closer to the hydraulic controller 70 is opened to the outside is provided. Furthermore, the oil passage 54*a* and the oil passage 54*c* are communicated with each other through the hydraulic controller 70 by mounting the hydraulic controller 70 on the side surface portion 2*c* of the cylinder block 2. Thus, simply by mounting the hydraulic controller 70 on the side surface portion 2*c* of the cylinder block 2 from the outside, the engine 100 having a simple oil passage structure (the structure of the oil passage 54 for actuating the oil jets 60 as needed while the oil 4 is constantly supplied to the crankshaft 30 or the like) can be easily obtained.

According to the first embodiment, the oil passage 71 having a tube shape and connecting the oil passage 54*a* and the oil passage 54*c* is formed in a region in which the hydraulic controller 70 and the side surface portion 2*c* of the cylinder block 2 face each other in a state where the hydraulic controller 70 is mounted on the side surface portion 2*c* of the cylinder block 2. Thus, the oil passage 71 having a tube shape can be easily formed simply by mounting the hydraulic controller 70 on the side surface portion 2*c* of the cylinder block 2 from the outside. Furthermore, the groove-like (gutter-shaped) oil passage 71 can be exposed on the mounting surface 70*b* of the hydraulic controller 70 simply by detaching the hydraulic controller 70 from the side surface portion 2*c* of the cylinder block 2 when the hydraulic controller 70 is disassembled and cleaned, for example. Therefore, the narrow oil passage 71 can be easily cleaned.

According to the first embodiment, the oil pump 40 that supplies the oil 4 to the oil jets 60 is further provided, and the hydraulic controller 70 is arranged between the oil pump 40 and the oil jets 60. Thus, when the oil passage 72 is opened, the oil 4 can be easily supplied to the oil jets 60 through the oil passage 71 and the oil passage 72 while the oil 4 is supplied to a downstream oil-requiring portion (crankshaft 30) only through the oil passage 71 in a constantly open state along with application of an oil pressure generated by the oil pump 40 to the hydraulic controller 70 (oil passage 54). More specifically, while the oil pressure generated by the oil pump 40 is properly utilized and controlled, control of switching a supply destination of the oil 4 can be easily performed according to the magnitude of the oil pressure.

According to the first embodiment, the valve body 74 capable of switching the oil passage 72 to an open state or closed state is provided in the hydraulic controller 70. Furthermore, the oil passage 72 is switched to an open state or closed state by driving the solenoid valve 80 and moving the valve body 74 with the oil pressure supplied to the oil jets 60. Thus, the solenoid valve 80 properly controls a way of applying the oil pressure to the valve body 74, whereby the oil passage 72 can be easily switched to an open state or closed state. Therefore, the power consumption of the engine 100 can be reduced unlike the case where the valve body 74 of the hydraulic controller 70 is moved directly utilizing an electric drive force.

According to the first embodiment, the oil passage 53 through which the oil 4 is supplied to the camshafts 1*a* and the valve mechanisms 1*b* and the oil passage 54 including the oil jets 60 that supply the oil 4 to the crankshaft 30 and the pistons 11 are provided in the cylinder block 2. Furthermore, the oil passage 54 includes the oil passage 71 and the oil passage 72 that is provided alongside of the oil passage 71 and is openable and closable. Thus, the hydraulic controller 70 including the single (common) oil passage 54 including the oil passage 71 and the oil passage 72 can be provided in the oil passage 54 through which the oil 4 is supplied to the crankshaft 30 and the back sides of the pistons 11. Thus, control of switching between start and stop of the oil jets 60 can be performed by the hydraulic controller 70 regardless of an operation of oil supply to the camshafts 1*a* and the valve mechanisms 1*b* (valve system) through the oil passage 53.

According to the first embodiment, the oil passage 54 is branched off from the oil passage 53 connected to the oil pump 40. Thus, the oil 4 can be reliably supplied to the crankshaft 30 through the oil passage 71 of the oil passage 54 branched off from the oil passage 53 through which the oil 4 is constantly supplied to the valve system during the operation of the engine 100. Furthermore, the oil passage 72 is opened as needed, whereby the oil 4 can be reliably supplied also to the crankshaft 30 and (the back sides of) the pistons 11.

According to the first embodiment, a control sequence of the solenoid valve 80 controls the oil passage 72 to be in an open state on the basis of at least one of that the temperatures of the pistons 11 have reached more than the prescribed value Tj and that the rotational speed of the crankshaft 30 has reached at least the prescribed value Rj. Thus, the oil passage 72 is closed when the temperatures of the pistons 11 have not reached the prescribed value Tj (in a state where the oil pressure is temporarily increased due to the oil viscosity at the low oil temperature such as immediately after the start of the engine 100), and hence supply (squirt) of the oil 4 to the back sides of the pistons 11 at the low oil temperature can be easily prevented. On the other hand, when the low oil temperature state is released and the engine 100 shifts to the high load (high rotational speed range) so that the oil pressure is increased, in addition to constant oil supply to the crankshaft 30, the oil 4 can be reliably supplied (squirted) also to the back sides of the pistons 11 through the oil jets 60. Thus, seizure of the pistons 11 can be easily prevented.

According to the first embodiment, the control sequence of the solenoid valve 80 determines whether or not the temperatures of the pistons 11 have reached more than the prescribed value Tj when the rotational speed of the crankshaft 30 has not reached at least the prescribed value Rj, and controls the oil passage 72 to be in an open state when the rotational speed of the crankshaft 30 has not reached at least the prescribed value Rj and the control sequence determines that the temperatures of the pistons 11 have reached more than the prescribed value Tj. Thus, even when the rotational speed of the engine 100 is in the low rotational speed range, the temperatures of the pistons 11 become higher in a circumstance where high load operation is performed (at the time of requiring a high torque such as when a vehicle ascends a hill at a low speed), and hence the oil 4 can be reliably supplied (squirted) to the back sides of the pistons 11 through the oil jets 60. Thus, the pistons 11 are properly cooled so that seizure of the pistons 11 can be easily prevented.

Second Embodiment

A second embodiment is now described with reference to FIGS. 7 and 8. In this second embodiment, an example of configuring an engine 200 using an oil pump 45 of a variable displacement type is described. In the figures, the same reference numerals as those in the aforementioned first embodiment are assigned to and show structures similar to those of the first embodiment. The oil pump 45 is an example of the "variable displacement oil pump" in the present invention. The engine 200 is an example of the "internal combustion engine" in the present invention.

Figure 7:
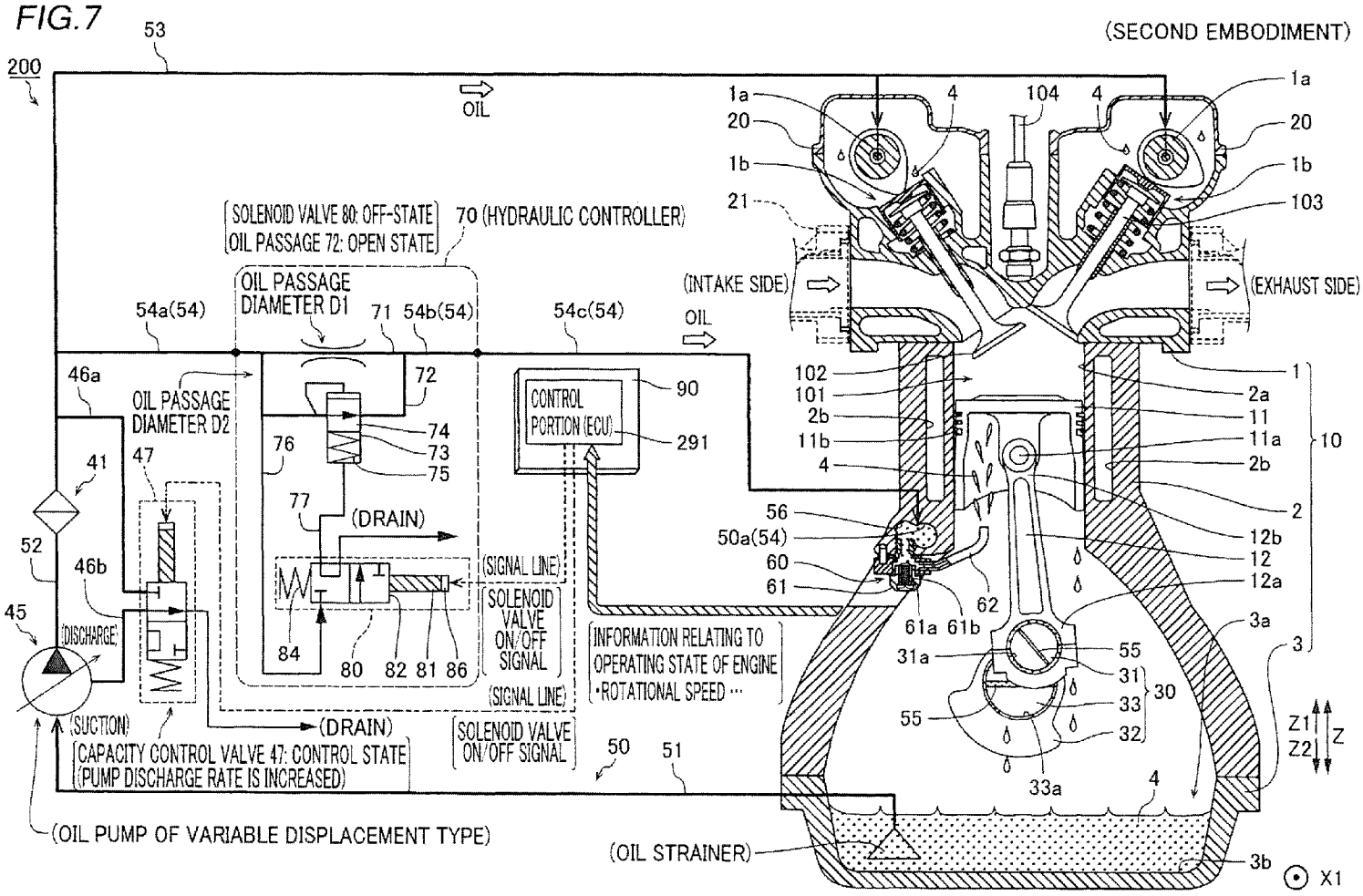
FIG. 7 A diagram schematically showing the overall structure of an engine and a lubricating system provided in the engine according to a second embodiment of the present invention.

The engine 200 according to the second embodiment of the present invention includes the oil pump 45 of a variable displacement type incorporated in an oil passage 50, as shown in FIG. 7. The oil pump 45 includes a mechanical portion (not shown) that mechanically increases and decreases a pump chamber volume. The oil pump 45 is connected with a capacity control valve 47 through oil passages 46*a* and 46*b*. As the capacity control valve 47, a type of solenoid valve is used. More specifically, energization and non-energization of a solenoid portion in the capacity control valve 47 are repetitively switched at predetermined pulse intervals on the basis of a command from a control portion (ECU) 291, whereby the oil pressure (discharge pressure) of the oil pump 45 is partially drawn into the oil pump 45 through the oil passages 46*a* and 46*b* at a predetermined timing. Driving of the mechanical portion that mechanically increases and decreases the pump chamber volume is controlled with this oil pressure. Thus, the discharge rate of the oil pump 45 at the same rotational speed can be increased and decreased. The capacity control valve 47 is an example of the "second solenoid valve" in the present invention.

Thus, according to the second embodiment, the oil pump 45 of a variable displacement type is used, and the capacity control valve 47 is controlled so that the discharge rate of the oil pump 45 is increased when a solenoid valve 80 switches an oil passage 72 to an open state. Therefore, the discharge rate of the oil pump 45 is increased, whereby oil 4 is supplied also to oil jets 60 through the oil passage 72 in a state where the oil 4 has an oil pressure sufficiently exceeding an operating pressure Pj. FIG. 7 shows the case where the capacity control valve 47 is controlled so that the discharge rate of the oil pump 45 is increased, and the solenoid valve 80 is placed in an off-state (non-excited state).

A processing flow of oil pressure control performed by the control portion (ECU) 291 in the engine 200 according to the second embodiment is now described with reference to FIGS. 7 and 8.

Figure 8:
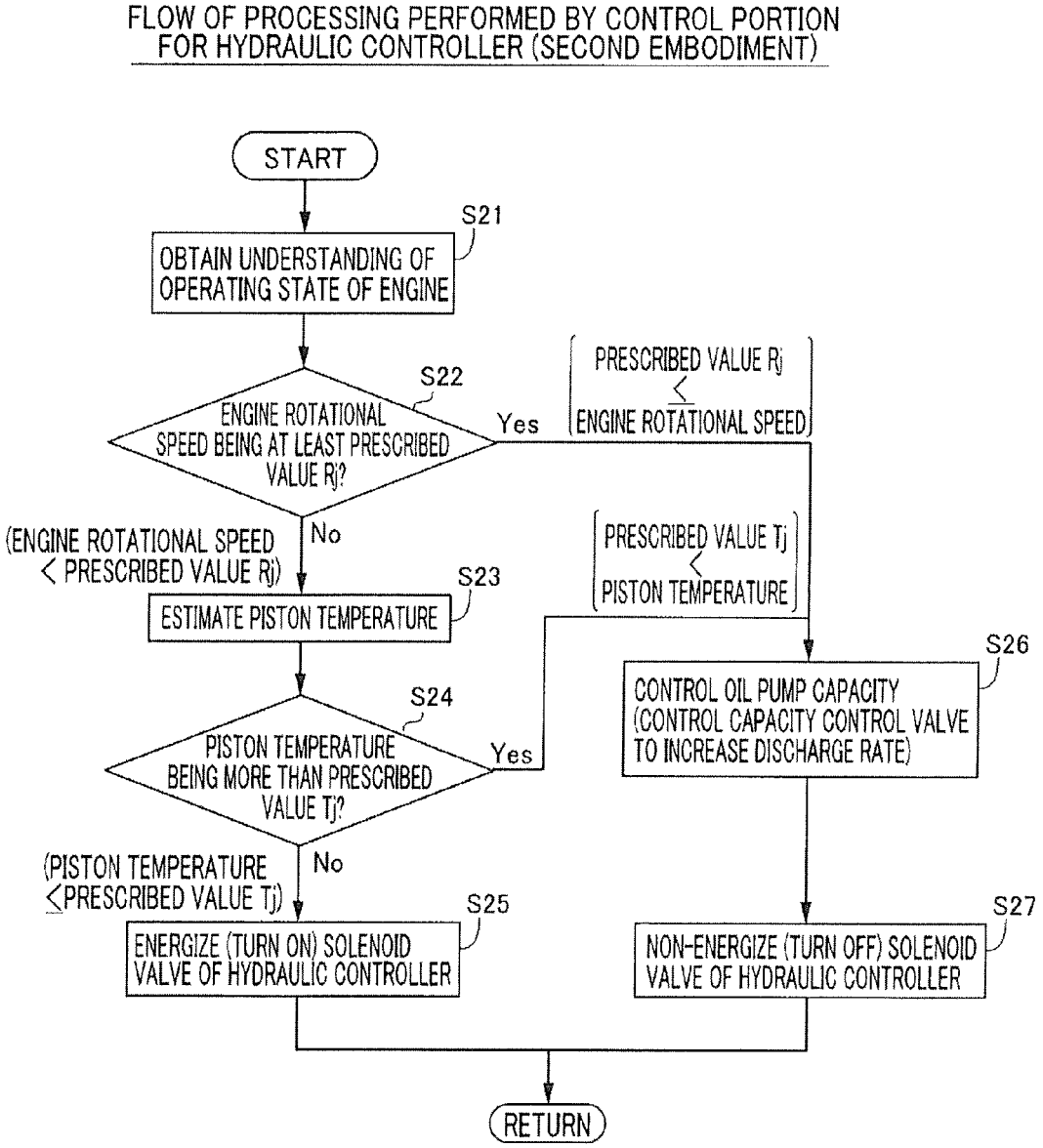
FIG. 8 A diagram showing a control flow for hydraulic control performed by a control portion (ECU) in the engine according to the second embodiment of the present invention.

First, at a step S21, the control portion 291 (see FIG. 7) obtains an understanding of the operating state of the engine 200 (see FIG. 7), as shown in FIG. 8. At a step S22, the control portion 291 determines whether or not the engine rotational speed is at least a prescribed value Rj (rotation/minute). When determining that the engine rotational speed is less than the prescribed value Rj at the step S22, the control portion 291 advances to a step S23, but when determining that the engine rotational speed is at least the prescribed value Rj, the control portion 291 advances to a step S26.

When the engine rotational speed is less than the prescribed value Rj, the temperatures of pistons 11 (see FIG. 1) are estimated on the basis of the engine rotational speed at the step S23. At a step S24, the control portion 291 determines whether or not the temperatures (estimated temperatures) of the pistons 11 are more than a prescribed value Tj. When determining that the temperatures (estimated temperatures) of the pistons 11 are not more than the prescribed value Tj at the step S24, the control portion 291 advances to a step S25, but when determining that the temperatures (estimated temperatures) of the pistons 11 are more than the prescribed value Tj, the control portion 291 advances to a step S26.

When it is determined that the temperatures of the pistons 11 are not more than the prescribed value Tj, the solenoid valve 80 is placed in an excited state (on-state) at the step S25, and then this control flow is terminated. More specifically, in a state where the solenoid valve 80 is energized (turned on), the oil passage 72 is closed, and the oil 4 flows only through the oil passage 71.

As shown in FIG. 8, when the engine rotational speed is at least the prescribed value Rj at the step S22 and when the temperatures (estimated temperatures) of the pistons 11 are more than the prescribed value Tj at the step S24, the capacity of the oil pump 45 is controlled at the step S26. Specifically, control of turning on and off the capacity control valve 47 is repeated at prescribed pulse intervals. In this case, according to the second embodiment, the mechanical portion (not shown) that mechanically increases and decreases the pump chamber volume is driven, and the capacity of the oil pump 45 is controlled in a direction in which the discharge rate is increased.

At a step S27, the solenoid valve 80 is placed in a non-energized state (off-state), and then this control flow is terminated. More specifically, in a state where the solenoid valve 80 is non-energized (non-excited), the oil passage 72 is opened so that the oil 4 flows through the oil passage 71 and the oil passage 72. In this case, the discharge rate of the oil pump 45 is increased, and hence the oil 4 is supplied to the oil jets 60 through the oil passage 72 in a state where the oil 4 has an oil pressure sufficiently exceeding the operating pressure Pj. After the termination of this control flow, this control flow shown in FIG. 8 is performed again after the elapse of a predetermined control cycle. In this manner, the control portion 291 controls the hydraulic controller 70 during the operation of the engine 200.

The remaining structures of the engine 200 according to the second embodiment are similar to those according to the aforementioned first embodiment.

According to the second embodiment, the following effects can be obtained.

According to the second embodiment, the oil pump 45 is used, and the discharge rate of the oil pump 45 is increased when the oil passage 72 is controlled to be in an open state by the solenoid valve 80. Thus, the discharge rate of the oil pump 45 is increased, whereby the oil 4 can be supplied to the oil jets 60 through the oil passage 72 in a state where the oil 4 has a sufficient oil pressure. More specifically, the oil 4 having an oil pressure higher than the operating pressure Pj can be easily supplied to the oil jets 60, and hence the oil 4 can be reliably squirted from the oil jets 60 to cool the pistons 11.

According to the second embodiment, the capacity control valve 47 that is connected to the oil pump 45 and controls the discharge rate of the oil pump 45 according to opening and closing control of the solenoid valve 80 of the hydraulic controller 70 is further provided. Thus, the discharge rate of the oil pump 45 to be controlled (driven) by the capacity control valve 47 (increase and decrease in the discharge rate) can be easily controlled by effectively utilizing the opening and closing operation of a drive valve, of which the response speed is fast, using the electromagnetic force of an electromagnet (solenoid portion).

The remaining effects of the second embodiment are similar to those of the aforementioned first embodiment.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the example of estimating the temperatures of the pistons 11 by detecting the engine rotational speed has been shown in each of the aforementioned first and second embodiments, the present invention is not restricted to this. The temperatures of the pistons 11 may be estimated by detecting the temperature of the cooling water that flows through the water jacket 2*b*, or the temperatures of the pistons 11 may be estimated by detecting the opening of a throttle valve connected to an intake system (air-intake apparatus 21) to detect (obtain) the load of the engine 100 (200), for example. Alternatively, the temperatures of the pistons 11 may be obtained by mounting a temperature sensor on a location where the temperatures of the pistons 11 can be directly detected.

While the example of configuring the hydraulic controller 70 to open or close the oil passage 72 by switching the flow passages in the main valve portion 82 with the oil pressure in the oil pump 40 (45) and with the directly actuated solenoid valve 80 and moving the valve body 74 forward or reversely has been shown in each of the aforementioned first and second embodiments, the present invention is not restricted to this. The hydraulic controller 70 may be configured to directly open or close the oil passage 72 by movement of the valve body 85 caused by energizing (turning on) or non-energizing (turning off) the solenoid portion 81 without utilizing the oil pressure in the oil pump 40 (45), for example. In addition to configuring the "opening-closing control portion" according to the present invention, using the solenoid valve 80 including the solenoid portion 81, the hydraulic controller 70 may be configured to open or close the oil passage 72 by moving the valve body with the power of an electric motor, of which forward and reverse rotation is controllable.

While the example of increasing and decreasing the discharge rate of the oil pump 45 by controlling the driving of the mechanical portion that controls the capacity control valve 47 including the solenoid valve to mechanically increase and decrease the pump chamber volume has been shown in the aforementioned second embodiment, the present invention is not restricted to this. For example, instead of the solenoid valve, a cam mechanism may be provided in a spool member on which the oil pressure (discharge pressure) in the oil pump 45 partially acts, and an oil pump configured to increase and decrease its pump chamber volume with the cam mechanism of the movable spool member may be used. In this case, the oil pump is preferably configured such that its pump chamber volume is increased by movement of the spool member following an increase in the oil pressure (discharge pressure).

While the example of controlling the oil passage 72 to be in an open state when the solenoid valve 80 is non-energized (non-excited: turned off) has been shown in each of the aforementioned first and second embodiments, the present invention is not restricted to this. The oil passage 72 may be controlled to be in an open state when the solenoid valve 80 is energized (excited: turned on), for example.

While the example of rendering the oil passage diameter D2 of the oil passage 72 larger than the oil passage diameter D1 of the oil passage 71 has been shown in each of the aforementioned first and second embodiments, the present invention is not restricted to this. The oil passage diameter D2 of the oil passage 72 and the oil passage diameter D1 of the oil passage 71 may be the same or nearly the same as each other, for example. Also in this case, the oil passage 72 is opened, whereby the oil passage diameter is increased as compared with the case of the oil passage 71 alone. Thus, the resistance (flow passage resistance) is reduced so that an oil pressure that is at least a higher oil pressure (operating pressure Pj) can flow.

While the control processing on the hydraulic controller 70 performed by the control portion 91 (291) is described, using the flowchart described in a flow-driven manner in which processing is performed in order along a processing flow for the convenience of illustration in each of the aforementioned first and second embodiments, the present invention is not restricted to this. According to the present invention, the processing performed by the control portion 91 (291) may be performed in an event-driven manner in which processing is performed on an event basis. In this case, the processing performed by the control portion may be performed in a complete event-driven manner or in a combination of an event-driven manner and a flow-driven manner.

While the example of applying the present invention to the engine 100 (200) in the vehicle such as a motor vehicle has been shown in each of the aforementioned first and second embodiments, the present invention is not restricted to this. The present invention may be applied to an internal combustion engine (engine) in equipment or the like other than the vehicle, for example. As the internal combustion engine, a gasoline engine, a diesel engine, a gas engine, etc. are applicable.

DESCRIPTION OF REFERENCE NUMERALS

1 cylinder head
1*a* camshaft (valve system)
1*b* valve mechanism (valve system)
2 cylinder block
2*a* cylinder
2*c* side surface portion
3 crank case
4 oil
10 engine body (internal combustion engine body)
11 piston
30 crankshaft
31 crankpin
33 crank journal
40 oil pump
45 oil pump (variable displacement oil pump)
47 capacity control valve (second solenoid valve)
53 oil passage (first circulation oil passage)
54, 54*b* oil passage (second circulation oil passage)
54*a* oil passage (upstream oil passage, second circulation oil passage)
54*c* oil passage (downstream oil passage, second circulation oil passage)
55, 56 oil passage
60 oil jet
61 valve portion

62 nozzle portion
70 hydraulic controller (hydraulic controller for an internal combustion engine)
70*b* mounting surface
71 oil passage (first passage)
72 oil passage (second passage)
80 solenoid valve (opening-closing control portion, first solenoid valve)
81 solenoid portion
82 main valve portion
91, 291 control portion (ECU)
100, 200 engine (internal combustion engine)

The invention claimed is:

1. An internal combustion engine comprising:
a piston;
an oil jet that operates at a predetermined operating pressure to supply oil to the piston; and
a hydraulic controller provided upstream of an oil passage including the oil jet, wherein
the hydraulic controller includes:
a first passage in a constantly open state, through which the oil having a pressure lower than the predetermined operating pressure is supplied to the oil jet,
a second passage provided alongside of the first passage and being openable and closable, through which the oil having a pressure higher than the predetermined operating pressure is supplied to the oil jet in combination with the first passage in a state where the second passage is opened, and
an opening-closing control portion that controls the second passage to be in an open state when actuating the oil jet, and controls the second passage to be in a closed state when stopping actuating the oil jet.

2. The internal combustion engine according to claim 1, wherein
the first passage includes a fixed restrictor in a constantly open state, having a first oil passage diameter, and
the second passage includes an openable and closable bypass passage having a second oil passage diameter larger than the first oil passage diameter.

3. The internal combustion engine according to claim 1, wherein
the opening-closing control portion includes a first solenoid valve that is connected to the second passage and controls opening and closing of the second passage.

4. The internal combustion engine according to claim 3, wherein
the second passage is controlled to be in the open state when the first solenoid valve is non-energized.

5. The internal combustion engine according to claim 1, further comprising an internal combustion engine body provided with an upstream oil passage located upstream of the hydraulic controller and a downstream oil passage located downstream of the hydraulic controller and including a side surface portion on which an end of each of the upstream oil passage and the downstream oil passage closer to the hydraulic controller is opened to an outside, wherein
the upstream oil passage and the downstream oil passage are communicated with each other through the hydraulic controller by mounting the hydraulic controller on the side surface portion of the internal combustion engine body.

6. The internal combustion engine according to claim 5, wherein
the first passage that has a tube shape and connects the upstream oil passage and the downstream oil passage is formed in a region in which the hydraulic controller and the side surface portion of the internal combustion engine body face each other in a state where the hydraulic controller is mounted on the side surface portion of the internal combustion engine body.

7. The internal combustion engine according to claim 1, further comprising an oil pump that supplies the oil to the oil jet, wherein
the hydraulic controller is arranged between the oil pump and the oil jet.

8. The internal combustion engine according to claim 7, wherein
the oil pump includes a variable displacement oil pump, and
a discharge rate of the variable displacement oil pump is increased when the second passage is controlled to be in the open state by the opening-closing control portion.

9. The internal combustion engine according to claim 8, further comprising a second solenoid valve that is connected to the variable displacement oil pump and controls the discharge rate of the variable displacement oil pump according to opening and closing control of the opening-closing control portion of the hydraulic controller.

10. The internal combustion engine according to claim 1, wherein
the hydraulic controller further includes a valve body capable of switching the second passage to the open state or closed state, and
the opening-closing control portion moves the valve body with an oil pressure supplied to the oil jet to switch the second passage to the open state or closed state.

11. The internal combustion engine according to claim 1, wherein
the oil passage includes a first circulation oil passage through which the oil is supplied to a valve system and a second circulation oil passage including the oil jet that supplies the oil to a crankshaft and the piston, and
the second circulation oil passage includes the first passage and the second passage provided alongside of the first passage and being openable and closable.

12. The internal combustion engine according to claim 11, further comprising an oil pump that supplies the oil to the oil jet, wherein
the second circulation oil passage is branched off from the first circulation oil passage connected to the oil pump.

13. The internal combustion engine according to claim 1, wherein
the opening-closing control portion controls the second passage to be in the open state on the basis of at least one of that a temperature of the piston has reached more than a predetermined temperature and that a rotational speed of a crankshaft has reached at least a predetermined rotational speed.

14. The internal combustion engine according to claim 13, wherein
the opening-closing control portion determines whether or not the temperature of the piston has reached more than the predetermined temperature when the rotational speed of the crankshaft has not reached at least the predetermined rotational speed, and controls the second passage to be in the open state when the rotational speed of the crankshaft has not reached at least the predetermined rotational speed and the opening-closing control portion determines that the temperature of the piston has reached more than the predetermined temperature.

15. A hydraulic controller for an internal combustion engine comprising:

a first passage in a constantly open state, provided upstream of an oil passage including an oil jet that supplies oil to a piston of the internal combustion engine by operating at a predetermined operating pressure, through which the oil having a pressure lower than the predetermined operating pressure is supplied to the oil jet;

a second passage provided alongside of the first passage and being openable and closable, through which the oil having a pressure higher than the predetermined operating pressure is supplied to the oil jet in combination with the first passage in a state where the second passage is opened; and an opening-closing control portion that controls the second passage to be in an open state when actuating the oil jet, and controls the second passage to be in a closed state when stopping actuating the oil jet.

* * * * *